United States Patent [19]

Pieri

[11] Patent Number: 4,537,006

[45] Date of Patent: Aug. 27, 1985

[54] AUTOMATIC APPARATUS FOR INDIVIDUALLY ENSHROUDING FRUIT AND VEGETABLE CONTAINERS IN A NET PROVIDED WITH A REINFORCING STRIP AND A LABEL

[75] Inventor: Vincenzo Pieri, Cesena, Italy

[73] Assignee: SORMA S.r.l., Italy

[21] Appl. No.: 573,968

[22] Filed: Jan. 26, 1984

[30] Foreign Application Priority Data

Mar. 25, 1983 [IT] Italy ..... 3378 A/83

[51] Int. Cl.[3] ..... B65B 9/15; B65B 51/05; B65B 61/14

[52] U.S. Cl. ..... 53/134; 53/137; 53/138 A; 53/576

[58] Field of Search ..... 53/134, 137, 138 A, 53/567, 576

[56] References Cited

U.S. PATENT DOCUMENTS 2,908,123 10/1959 Muller ..... 53/567 X
3,945,171 3/1976 Marietta, Jr. ..... 53/576

FOREIGN PATENT DOCUMENTS 236873 3/1964 Austria ..... 53/138 A

*Primary Examiner*—John Sipos
*Attorney, Agent, or Firm*—Darby & Darby

[57] ABSTRACT

Disclosed herein is an apparatus that comprises a station for infeeding containers that subsequently pass inside a net carrying pipe and are supplied to a station where each container is enshrouded in a net and at which there is a station for fixing the reinforcing strips to the containers as well as a station for labelling the said containers, all the said stations operating automatically and on a time relationship basis, one with the other.

10 Claims, 9 Drawing Figures

AUTOMATIC APPARATUS FOR INDIVIDUALLY ENSHROUDING FRUIT AND VEGETABLE CONTAINERS IN A NET PROVIDED WITH A REINFORCING STRIP AND A LABEL

BACKGROUND OF THE INVENTION

The invention relates to an automatic apparatus for individually enshrouding fruit and vegetable containers in a net provided with a reinforcing strip and a label.

DESCRIPTION OF THE PRIOR ART

As is known, use is normally made, in the field concerned with individually enshrouding fruit and vegetable containers in a net, of a circular section tubular element provided externally with a net, tightly twisted there around, destined to be used to enshroud the said containers; the tubular element in question being known as the "net carrying pipe".

With the front extremity of the net mounted around the said pipe first being sealed, in such a way as to form a sort of intestine made out of a net, the various fruit and vegetable containers are manually transferred into the inside of the pipe, from the other extremity of which they issue completely enshrouded, and the exception of the rear part thereof, in the net intestine that encloses the said pipe. After this, the operator has the task of grasphing hold of the front part of the netting upstream of each container, that is to say, the part of the net connected to the net carrying pipe, and of positioning the said front part of the netting at a point corresponding to where the head of a normal type mechanical group for the sealing, by means of metal staples, and for the cutting thereof is located.

In this way, the first container is enshrouded in the net while the remainder of this, immediately upstream of the enshrouded container, is again sealed at the front, ready to receive a second container.

The said system obviously requires a considerable amount of manual labour and is somewhat slow from the viewpoint of the hourly output of netted containers.

Another solution, partially automated, envisages there being a supporting frame on which is placed a net carrying pipe inside which provision is made for a passageway for the containers and along which a longitudinal element provided with a plurality of projecting parts is able to move, guided, alternately in the two directions. The said projecting parts are equidistant, the spacing corresponding to the length of one container, the purpose thereof being to define a undirectional locator member in the direction in which each container issues from the pipe, in such a way as to cause each container to traverse, one step at a time, from the entry point to the exit point of the pipe.

With this particular solution, the operation of netting the container—and this alone—is rendered partially automatic, an operator still being required to attend to placing the front part of the netting at a point corresponding to where the mechanical group for the sealing and the cutting thereof is located.

SUMMARY OF THE INVENTION

The object of the invention is to overcome the aforementioned difficulties by making available an automatic apparatus for individually enshrouding fruit and vegetable containers in a net provided with a reinforcing strip and a label, in which there are a number of in-line stations. In particular, the said apparatus comprises a station for infeeding containers that subsequently pass inside a net carrying pipe and are supplied to a station where each container is enshrouded in a net and at which there is a station for fixing the reinforcing strips to the containers as well as a station for labelling the said containers, all the said stations operating automatically on a time relationship basis, one with the other.

The advantages to be had with the apparatus according to the invention consist essentially in a very high output per hour of netted containers and in the labour requirements being almost nil since all that has to be done is to place the containers on the infeed station.

BRIEF DESCRIPTION OF THE DRAWINGS

Further characteristics and advantages of the apparatus according to the invention will become more apparent from the detailed description that follows, illustrated purely as an unlimited example on the accompanying drawings, in which.

DESCRIPTION OF THE PREFERRED EMBODIMENT

Figure 1:
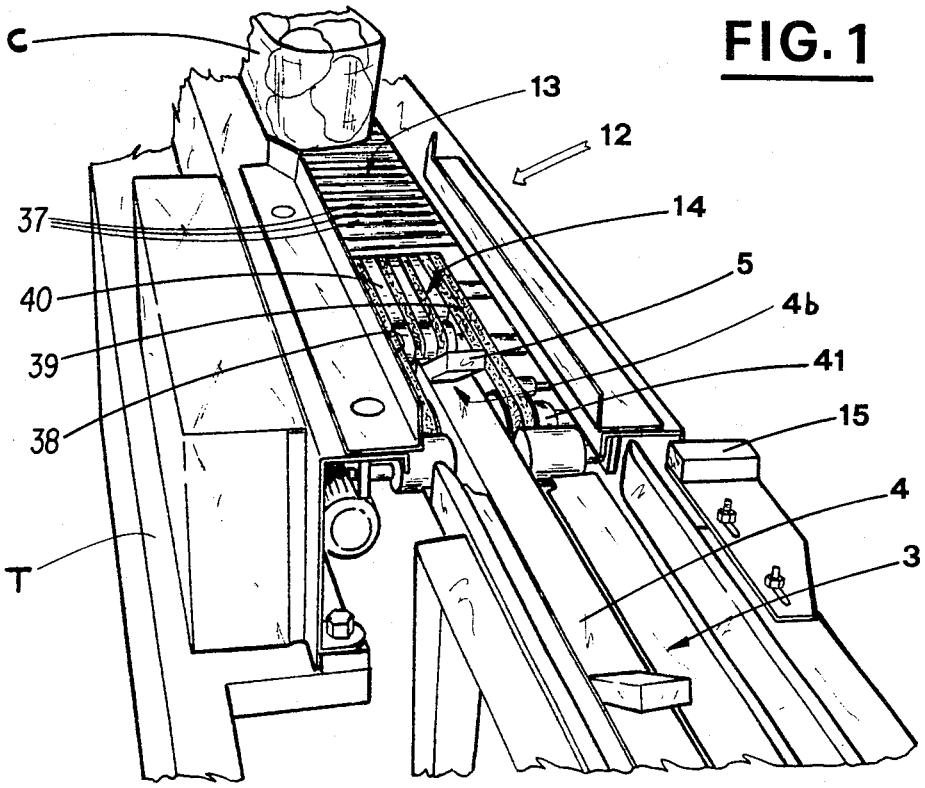
FIG. 1 shows, in a perspective view, the station for the infeeding of the containers.
Figure 2:
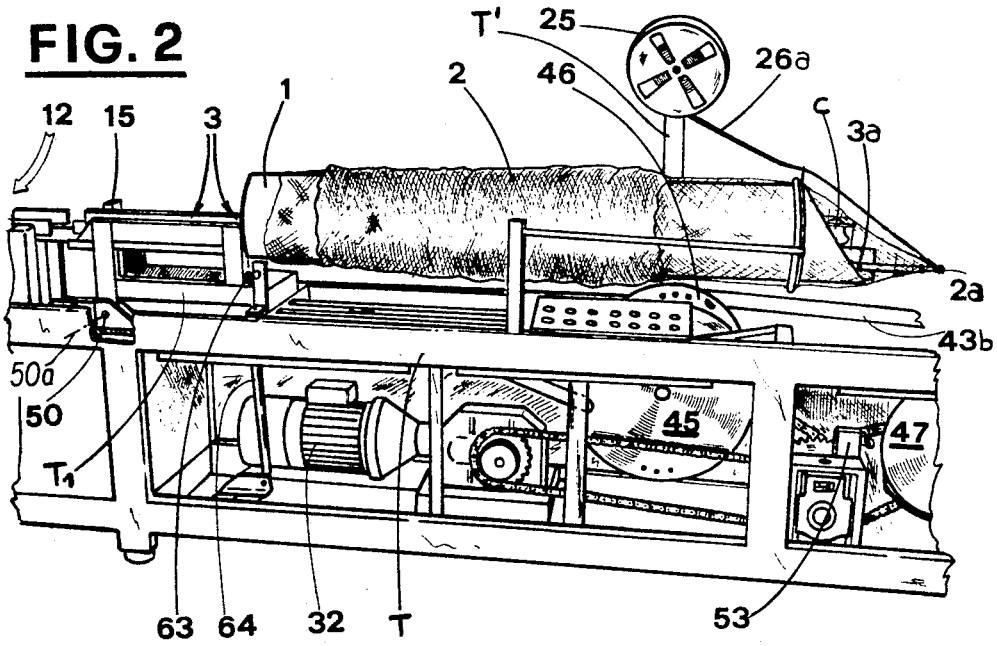
FIG. 2 shows, in a perspective view, the central part of the apparatus in question that is immediately downstream of the infeed station depicted in FIG. 1.

With reference to the above listed drawings, the automatic apparatus forming the subject of the invention comprises, in brief, starting upstream and going downstream along the infeed path of the containers C:

a station 12 for infeeding the containers C, sustained by a supporting frame T and provided with a drive motor 16; the said infeed station also comprising a normal type net carrying pipe 1 that is sustained by a frame T', in turn sustained by the frame T;

a station 17 for enshrouding in a net each container C, in turn comprising: a guillotine device 19 that allows each container C coming from the pipe 1 to pass and then keeps a firm hold on the front part of the netting upstream of the container C once this has moved beyond the gulliotine device 19; and a normal type group 6 for sealing and cutting the front part 2*b* of the net 2;

a labelling station 29 comprising a normal type labelling group 11 that supplies label in harmony with the operation of the sealing and cutting group 6;

one single main motor 32, sustained by the frame T, for driving contemporaneously on a time relationship basis, all the principal moving parts of the various stations concerned.

In greater detail the infeed station 12 has, starting upstream and going downstream: a first conveyor 13 for the containers C that are kept placed on this one at the side of the other; a second conveyor 14 whose speed is faster than that of the first conveyor in order to space the containers slightly apart; the said net carrying pipe 1 that is interlocked to the motor 32 and effects the automatic transfer of the containers C from the said second conveyor 14 to the previously mentioned netting station 17, as will be seen more clearly from the ensuing text. The two conveyors are driven by a motor 16 which, through a normal type mechanical system comprising a pinion 65, a chain 66 and a pinion 67, passes the rotatory motion onto a first shaft 68 that serves as the drive shaft of the conveyor 13. To the said shaft is keyed another pinion 69 (larger than the others) and, through a chain 70 and a pinion 71 (smaller than the others), the shaft 68 carries in rotation a second shaft 72 that serves as the drive shaft of the conveyor 14. In this way, the conveyor 13 moves at a lesser speed than the conveyor 14.

The first conveyor 13 comprises two endless chains 33 and 34, respectively, the former mounted on the pinions 35 and the latter on the pinions 36, the said chains being placed one parallel to the other and interconnected through a plurality of rollers 37 of a width slightly greater than each of the containers C.

The second conveyor 14 comprises, instead, at least one pair of belts 38 and 39 whose upper ramification is placed at the same elevation as the plane defined by the idle rollers 37, the said belts being endlessly mounted around the pulleys 40 and 41, respectively, placed one parallel to the other at a distance apart such as to leave free access to the rear extremity **4*b* of a movable longitudinal element 4 utilized for the automatic transfer into the inside of the net carrying pipe 1 of the conveyors, as will be seen more clearly below. The radius of the front pulleys 41 is greater than the height or gauge of the said longitudinal element 4 so as to allow free access to this in between the said belts 38 and 39**.

Figure 3:
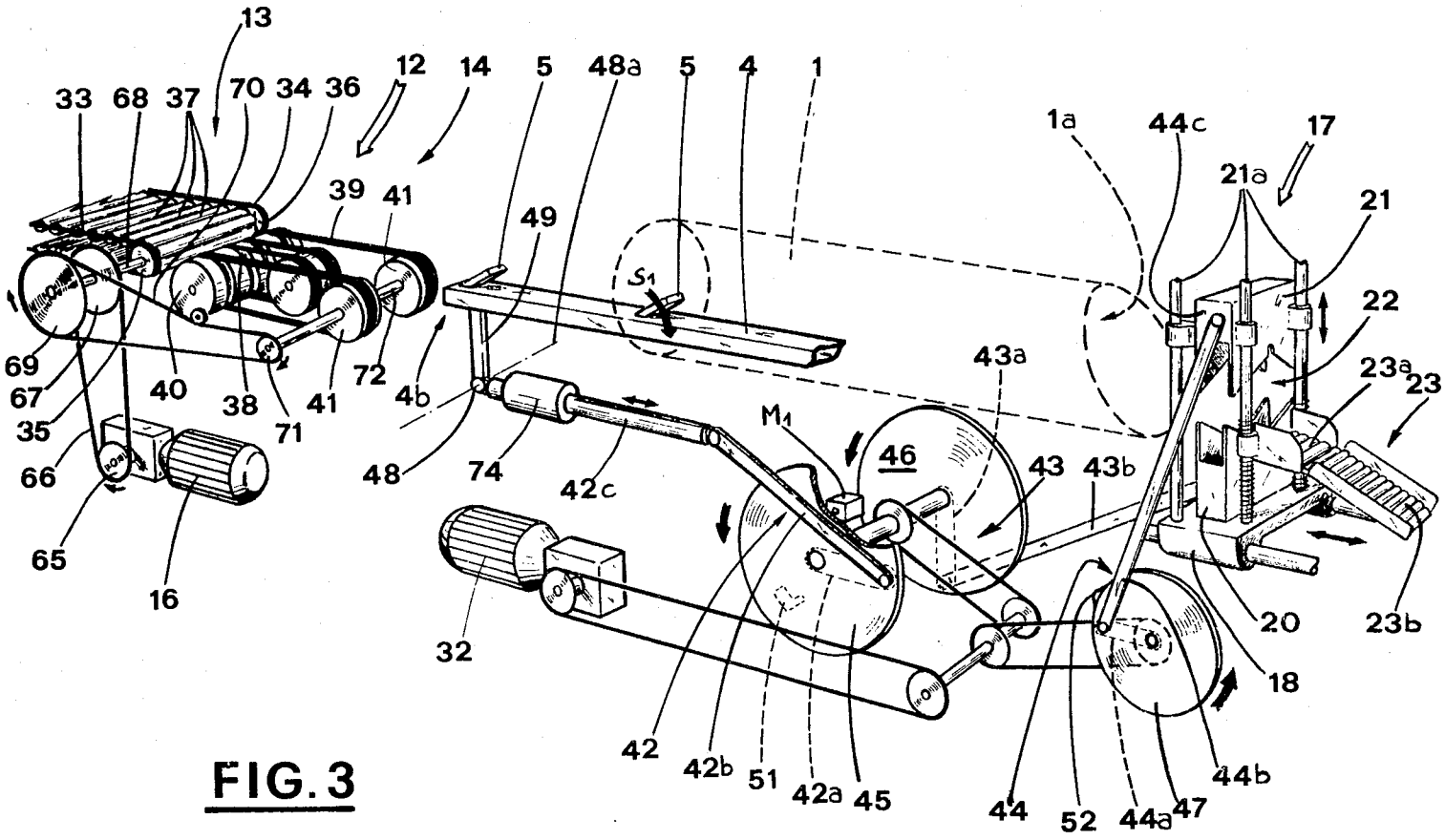
FIG. 3 shows, in a perspective view, the main component parts of the apparatus in question, with the supporting frame and other parts removed in order that the operation of the apparatus in question be more readily appreciated.

The pipe 1, the external surface of which carries the net 2 whose front extremity **2*a* is so sealed as to form a sort of intestine made out of a net, is provided internally with a channel 3 through which the containers C can pass. The said longitudinal element 4, provided with a plurality of equidistant projecting parts 5 whose spacing apart is at least identical to the length of any one container C, is able to traverse in the said channel, guided, alternately in the two directions. The said projecting parts 5 are maintained elastically raised but are able to rotate in the direction $S_1$ (as shown in FIG. 3) every time the longitudinal element 4 moves backwards and the individual projecting parts 5 locate the front edge of each containers C. In this way, each projecting part 5 defines a unidirectional locator member in the direction in which each container C issues from the pipe 1**, so as to cause each container to move one step at a time from the entry point to the exit point of the pipe.

The longitudinal element 4 traverses alternately from a first extreme backward position, in which the rear extremity **4*b* thereof is partly inserted inside the second conveyor 14, in between the belts 38 and 39**, to withdraw a container C waiting there, to a second extreme forward position, in which each container C moves forward one step.

When obscured by a container C, a photocell 15 placed immediately downstream of the second conveyor 14, interrupts the circuit that supplies electricity to the motor 16, the purpose of this being to allow the longitudinal element 4 to collect each container obscuring the photocell 15, in order to subsequently displace the container concerned one step forward.

The previously mentioned group 6 for sealing and cutting the net (FIG. 7) is positioned downstream of the pipe 1, on the same supporting frame T. The said group comprising a sealing and a cutting head **6*a* that operates transversely, with respect to the direction in which the containers C move forward, on the net 2 to be sealed and cut. The non-operative periods of the head 6*a* are initiated with the consent of a microswitch 7 (FIG. 5) that can be tripped by a cam 8 fitted on the output shaft 9 of geared motor 10 that controls the sealing and cutting group 6**.

The station 17 at which each container C is enshrouded in a net, is placed completely on a carriage downstream of the net carrying pipe 1, sustained in a way whereby it is able to slide, by the frame T, and movable alternately in the two directions along the path followed by the containers C as they move forward. To the said carriage, shown at 18, is fixed, in addition to the sealing and cutting group 6, the said guillotine device 19, the lower part of which is constituted by a first pair of stationary locator elements 20 of V conformation, placed transversely to the forward movement direction of the containers C and spaced with corresponding parallelism in such a way as to accept there between, in the region of the vertex of the V, the sealing and cutting head **6*a* of the group 6. Above the said first pair of stationary elements 20 is placed a second pair of movable locator elements 21 of upside down V conformation that operate in contrast with the said first elements. The operating planes of the locator elements 21 are slightly staggered with respect to the operating planes of the stationary locator elements 20. The movable locator elements 21 are sustained by a set of three columns 21*a*, integral with the carriage 18, in a way whereby they are able to slide and thus they are able to traverse vertically in the two directions, from a first raised position (see FIG. 7) the coincides with the maximum forward position of the carriage 18 towards the pipe 1**, to a second extreme lowered position (see FIG. 8).

When the pair of movable elements 21 are in the said raised position they form, along with the pair of stationary elements 20, rhomboid aperture 22 such as to allow the free passage of each container C, enshrouded in the net 2, and of a pair of extension members **3*a* destined to support the container C immediately prior to the transfer of this, on the part of the said longitudinal element 4, to way past the guillotine device 19 where there is a transiting platform for the containers C. In the extreme lowered position of the said movable elements 21, instead, the said carriage 18 is placed sufficiently to the rear for them not to be in contact with the end support extension members 3*a* of each container C, while the vertices of the V thereof define a small aperture 22*a* sufficient to firmly restrain, in the correct position, the front part 2*b* of the netting 2 immediately upstream of each container C already positioned on the transiting platform 23. The said platform is constituted by an idle roller surface 23*a* supported by two lateral walls 55 that are integral with bushings 56 mounted on the columns 21*a* downstream of the guillotine device 19. The roller surface 23*a* is kept at the level of the pipe 1 slide path for the containers C, this being achieved through the action on the roller surface 23*a* of helical springs 57 interposed between each busning 56 and the plane of the carriage 18. Above each bushing 56, along the said columns 21*a*, are placed a similar number of helical springs 58** with which the said second pair of movable locator elements 21 are destined to meet elastically in the final movement towards the said extreme lowered position. More particularly, since the sliding motion, along the said columns 21*a*, of the movable locator elements 21 occurs in sliding engagement with the bushings 73 with which the said elements are provided, the actual contact with the helical springs 58 is made by the said bushings. When the elements 21 make contact with the springs 58, the former practically carry with them the transiting platform 23 in such a way that the axis of the container C placed thereon be coincident with the axis of the said small aperture 22*a*. Only in this fashion can the best possible netting of each container C be achieved. If, in fact, each container C were to remain for some time on a fixed transiting platform 23, the net 2 that enshrouds the said container would be subject to stretch in the upper part and to slacken, instead, in the bottom part; furthermore, there would be the possibility of the net 2 not attaching itself to the outer surface of the whole container C.

When, therefore, the longitudinal axis of the container C is coincident with the axis of the small aperture 22*a*, the operation takes place of the said sealing and cutting head 6*a* since this is the moment when, insofar as the operating parts are concerned, the optimal position of the container C is reached. Pivoted downstream of the said idler roller surface 23*a* is a sloping idle roller surface 23*b* that is supported by the lateral walls 59 and is provided, at the outgoing point, with a pair of sliding rollers 60 movable, in a guided fashion, along a fixed surface 61 that connects the exit of the sloping surface 23*b* with a station where all the netted containers are collected, shown at 62 in FIG. 6. In this way, the sloping surface 23*b* freely follows the displacement of the transiting platform 23 and, at the same time, guides all the containers C into the said station 62.

Referring again to the netting station 17 and, in particular, to the sealing and cutting group 6, note should be taken of the fact that, in the region of the said guillotine device 19, a photocell 54 is present and that this, when obscured by the passing of a container C, trips a micro proximity switch $M_2$ (FIG. 5) that is placed along the path followed by the carriage 18 and is destined to set in operation the sealing and cutting head 6*a* at the time the said carriage 18 is in the previously mentioned rear position corresponding to the second extreme lowered position of the said movable locator elements 21. Obviously, in the event of the photocell not being obscured because of the containers C to be netted having come to an end, the sealing head cannot be set in operation.

The station 24 for the fitting on of the container reinforcing strips 26 comprises a reel 25 that contains a long strip 26*a* and is carried by a frame T′ which, in turn, is fixed to the supporting frame T in front of the guillotine device 19. The strip 26*a* is naturally free to unwind from the said reel.

Prior to starting up the complete apparatus, the operator is required to pass the strip 26*a* firstly through a ring 27 placed on the outgoing part 1*a* of the net carrying pipe 1 (FIG. 6), then inside a slot 28 made in the region of the vertex of the movable locator element 21 further upstream, and finally to fix the said strip 26*a* at a point corresponding to where the front part 2*a* of the net 2 supported by the pipe 1 is sealed so as to form a sort of intestine. This initial sealing and fixing of the strip 26*a* can, naturally, be performed manually. From that moment on, however, every time the said net is sealed and cut, a corresponding fixing of the strip 26*a* to the containers C is brought about.

The labelling station 29, downstream of the label supply group 11 that furnishes one pair of wire connected labels 30 at a time, is provided with a chute 31 fitted to the side of the said first pair of stationary locator elements 20. The said chute is utilized to transfer by gravity each pair of labels 30 from the group 11 to the vertex of the V of the said stationary locator elements 20 where the sealing and cutting head 6*a* operates. Each pair of labels 30 comes down the chute with one label hanging from one side thereof and with the other label hanging from the other side thereof so that with every operation of the sealing and cutting head 6*a*, one label 30 is contemporaneously secured to two containers C at a time.

The one and only main motor 32, mentioned previously, provides contemporaneously and on a time relationship basis, the longitudinal element 4, the second movable locator elements 21 and the said carriage 18, with their motion. The drive is transmitted through the crank mechanisms 42, 43 and 44 that correspond to the longitudinal element 4, the second movable locator elements 21 and the said carriage, respectively. Accuracy in the timing of all the movements is guaranteed by suitable differences in phase between the corresponding cranks 42*a*, 43*a* and 44*a*, respectively, all of which rotate at the same angular velocity (see FIG. 3).

The length of the crank 42*a*, the connecting rod 42*b* and the slide 42*c* belonging to the crank mechanism 42, that of the crank 43*a*, the connecting rod 43*b* and the relevant slide, coinciding with the carriage 18, belonging to the crank mechanism 43 and that of the crank 44*a*, the connecting rod 44*b* and the slide 44*c* belonging to the crank mechanism 44, is determined solely by the positions adopted, in the space, by the longitudinal element 4, the second movable locator elements 21 and the carriage 18, respectively.

In the embodiment illustrated purely as an unlimited example in the accompanying figures, the difference in phase between the crank 42*a* and the crank 43*a* is approximately 110°, while the difference in phase between the crank 42*a* and the crank 44*a* is roughly a little less than 180°.

It should also be noted that in practice the cranks 42*a*, 43*a* and 44*a* are constituted by the disks 45, 46 and 47, respectively, of a radius obviously equivalent to the length of the corresponding cranks. In this way, the cranks also have a "flywheel" function in order to render the various movements softer and vibration free, above all in the region of the dead center.

Present peripherally on the disk 47 is a projection 52 destined to hit, cyclically, against a valve 53 that is supported by the frame T and gives consent to a pneumatic device, of a known type, a blow cleansing air into the inside of the sealing and cutting head 6*a* every time this has operated.

The slide 42*c* belonging to the crank mechanism 42 of the longitudinal element 4 is kept horizontal since it is guided by a horizontally placed bushing 74. Furthermore, the slide 42*c* has at the head thereof a pivot 48 to which is fastened a rod 49, integral with the longitudinal element 4. Likewise, the sustaining frame T′ of the net carrying pipe 1 has, at the rear, a further pivot 50 around which the frame T′ is able to rotate when it is wished to raise the net carrying pipe in order to replace the pipe with another pre-charged with netting. It is obvious, however, that the frame T′ would not be able to rotate if the said pivot 48 of the slide 42*c* were not on the same axis as the pivot 50. For this purpose, a microswitch $M_1$ has been placed in the frame T so that it can be tripped cyclically, naturally only when electrically energized, by a projection 51 located, for example, in the region of the disk 45, in order to give consent to the halting of the main motor 32 at the very moment when the axis 48*a* of the pivot 48 is coincident with the axis 50*a* of the pivot 50. Moreover, the frame T' is provided with a device 63 for blocking itself in the lowered position. The said device 63 is needed since the frame T' is constantly subjected to a force directed upwards, applied downstream of the pivot 50 and supplied by a gas piston 64 integral with the lower part of the supporting frame T. In this way, once the device 63 has been released, the raising of the frame T' is automatic.

As already stated, FIGS. 4, 5, 6, 7, 8 and 9 illustrate the various sequential stages of the operations effected from the existing of each container C from the net carrying pipe 1 to the expulsion of the said container towards the collection station 62.

Figure 4:
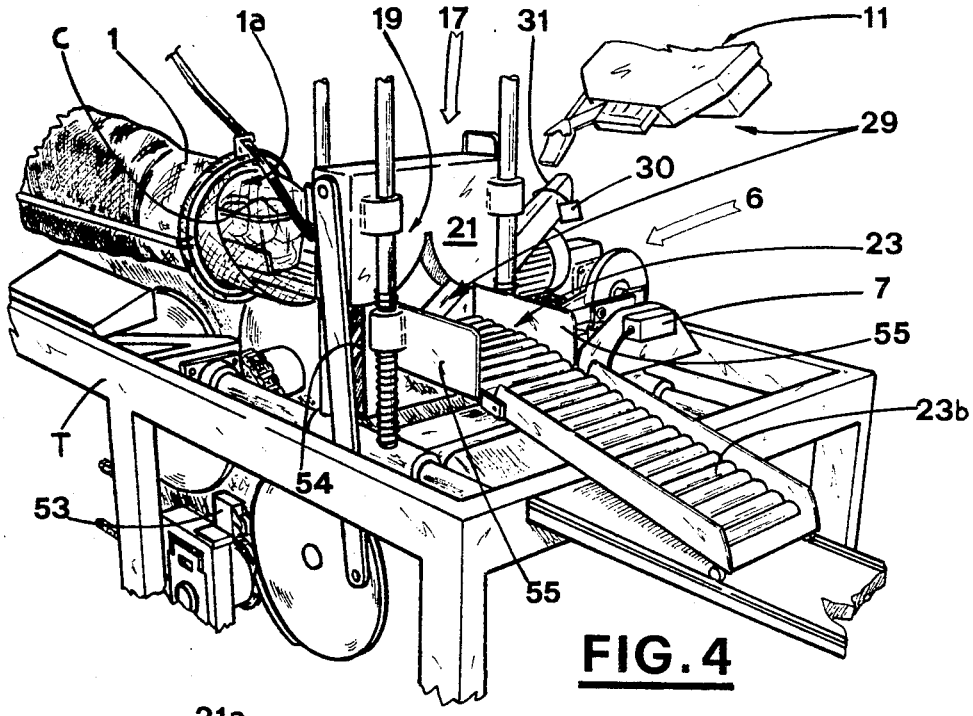
FIGS. 4, 5, 6, 7, 8 and 9 show, in various perspective views and with certain parts removed so that others may be seen better, the end part of the apparatus in question, sequentially in the various stages between the exiting of a container from the net carrying pipe and the time when the said container has been netted perfectly and been sent to a collection station.

In FIG. 4 a container C can be seen to be arriving in the region of the outlet 1*a* of the pipe 1. In the said situation the carriage 18 is approaching the outlet 1*a* while the movable locator elements 21 are moving upwards in order to arrive progressively in the open position sufficient for the passage of the container C, the longitudinal element 4 and the extension members 3*a*. At this stage, the label supply group 11 proceeds with furnishing a pair of labels, while the sealing and cutting group 6 is non-operative.

Figure 5:
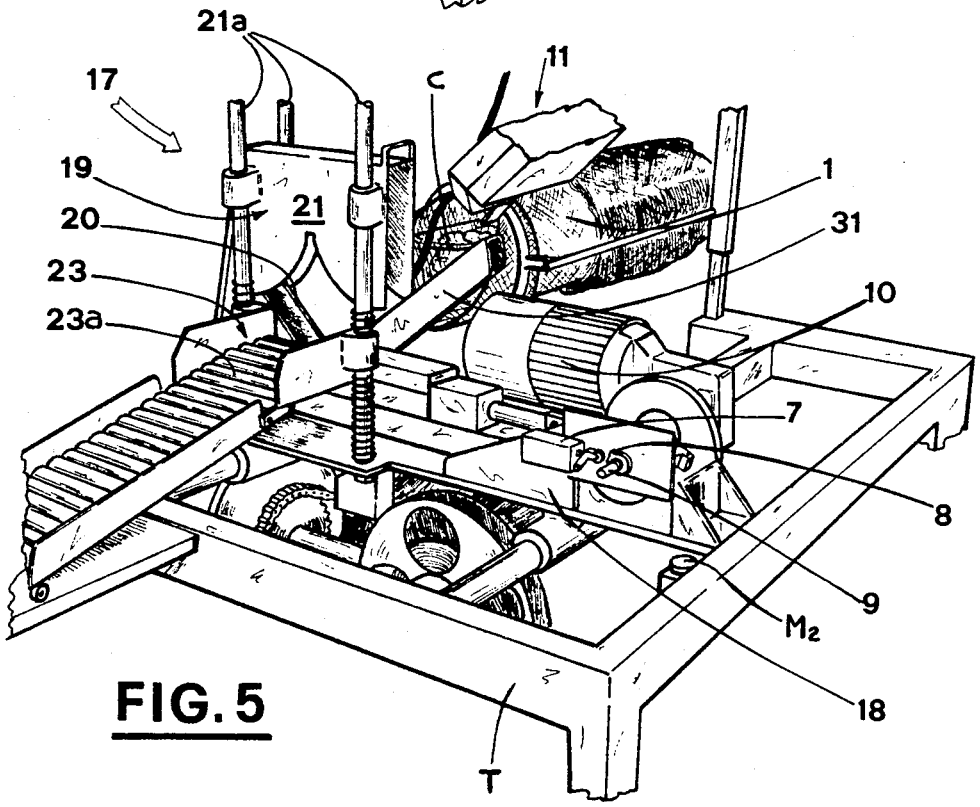

FIG. 5 shows, in a perspective view reversed with respect to FIG. 4, that under the effect of the longitudinal element 4, the container C has moved further forward, as has also the carriage 18, and that the pair of movable locator elements 21 have moved further upwards.

Figure 6:
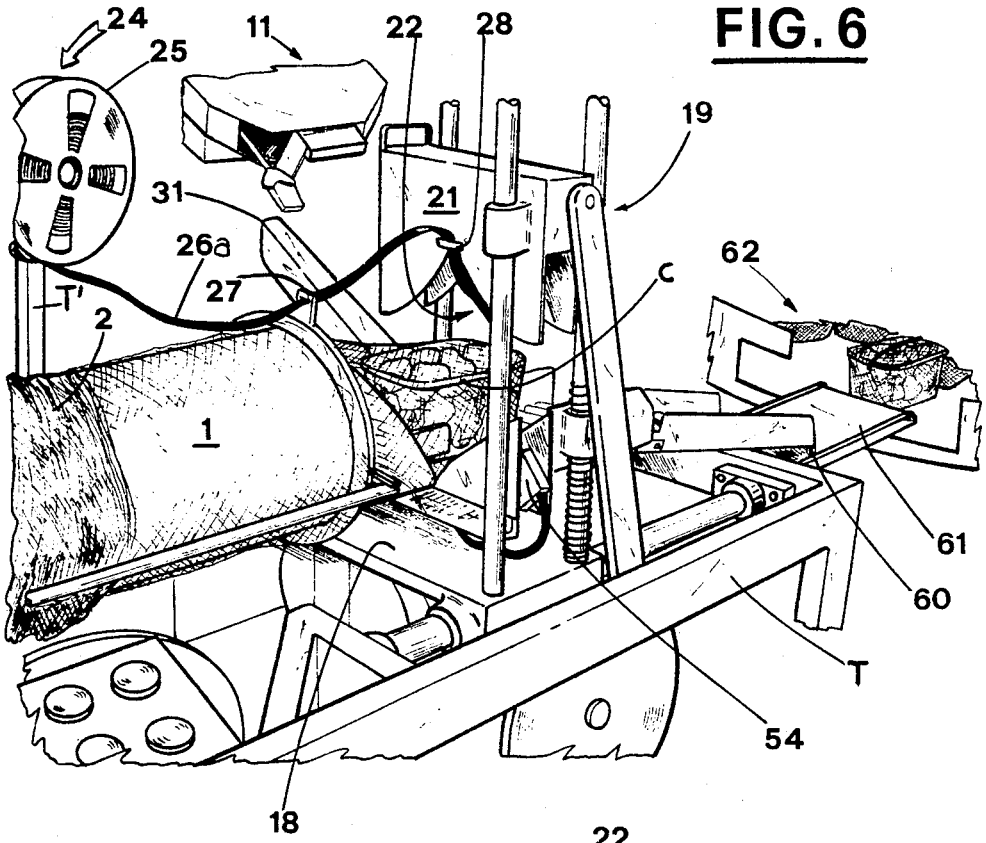

In FIG. 6 the container C can be seen to be about to pass across the rhomboid aperture 22 and to obscure the photocell 54 thereby tripping the micro proximity switch $M_2$ which, in this way, is set to operate the sealing and cutting of the net once the carriage 18 has returned to the rear position.

Figure 7:
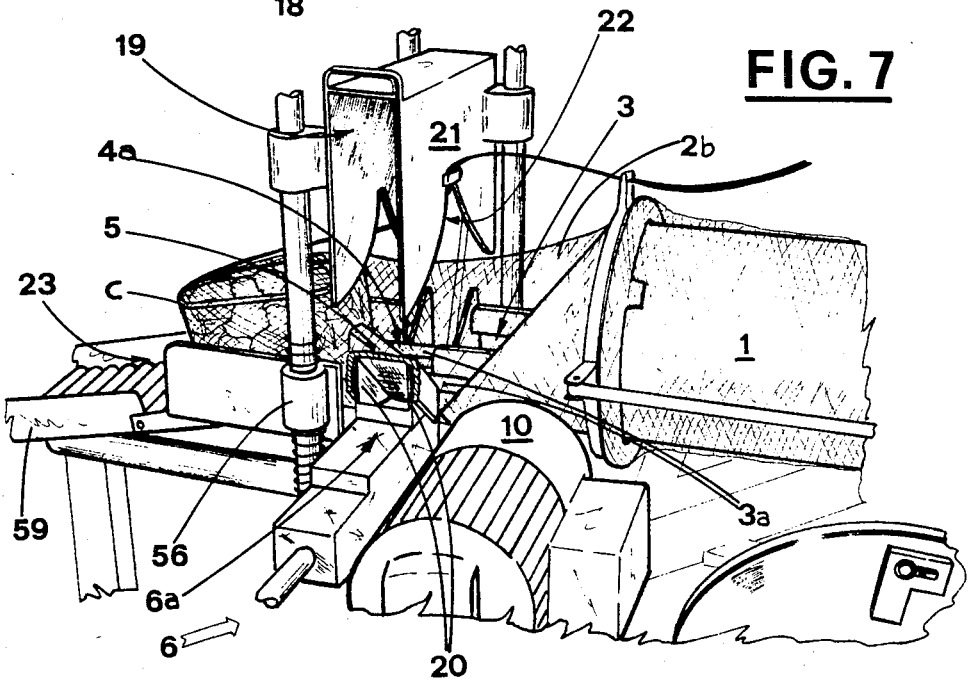

FIG. 7 shows the maximum approach position to the outlet of the net carrying pipe 1 of the carriage 18. The container C has already passed through the aperture 22 and is placed ready on the transiting platform 23. In this situation the movable locator elements 21 are already moving downwards, while the longitudinal element 4 and the extension members 23*a* commence, from that moment on, to move backwards.

Figure 8:
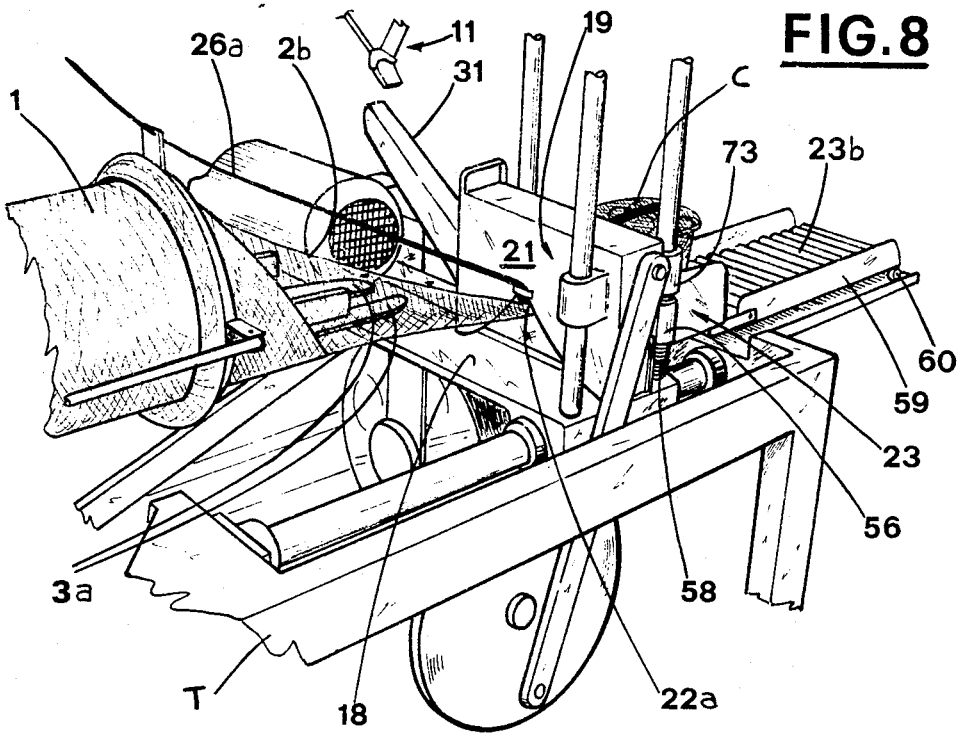

From the position illustrated in FIG. 7, the movable locator elements 21 are lowered progressively, and the carriage 18 moves backwards until the micro proximity switch $M_2$ that gives operation consent to the sealing and cutting head 6*a*, is tripped, as illustrated in FIG. 8. While the labels 30 are located ready in the region of the head 6*a*, the strip 26*a* is superposed over the front part 2*b* of the net 2, in such a way that the sealing and cutting operation affects not only the net 2 but also the strip 26*a* and the labels 30.

When the movable locator elements 21 move downwards as far as the sealing and cutting position, the transiting platform 23 is also located downwards at the optimal level, as stated above, unimpeded by the presence of the sloping surface 23*b* which, being pivoted to the transiting platform 23 and able to slide on the rollers 60, rests almost horizontal.

Figure 9:
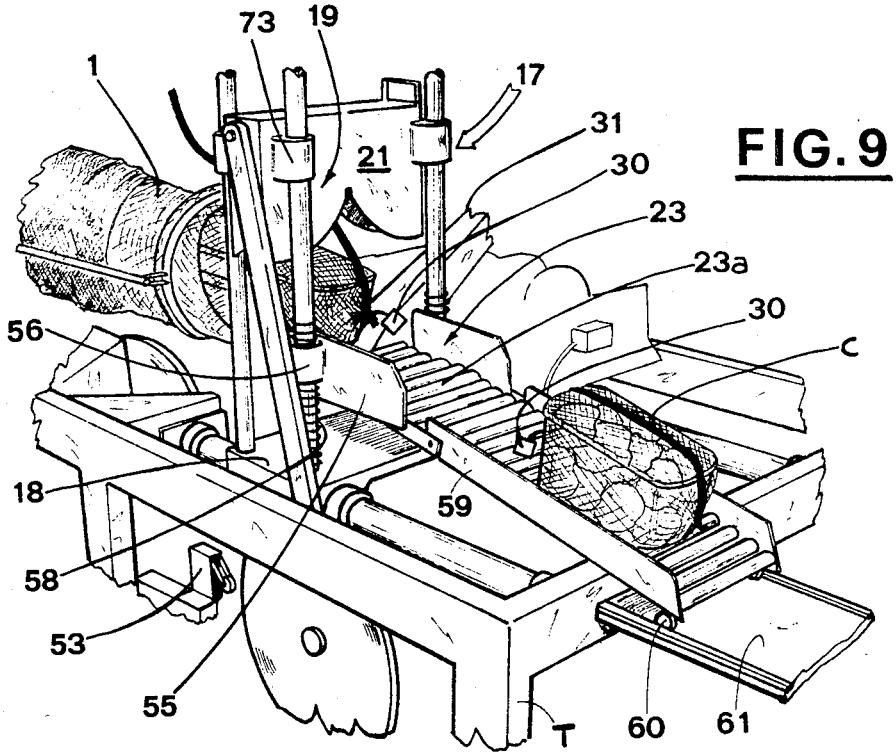

In FIG. 9 the container C can be seen to have been netted, all the operations carried out thereon having been completed. The carriage 18 thus resumes moving forward and the movable locator elements 21 rising in order to allow the next container C, already provided with a label 30, to pass out of the net carrying pipe 1, thereby repeating a fresh cycle.

What is claimed is:

1. Automatic apparatus for individually enshrouding fruit and vegetable containers in a net provided with a reinforcing strip and a label, comprising:

a station for infeeding the containers, sustained by a supporting frame and having, starting upstream and working downstream in the direction in which the containers move forward; a first conveyor for the containers; a second conveyor whose speed is greater than that of the first conveyor; a photocell, placed immediately downstream of the second conveyor, the obscuring of which, in the part of each container, interrupts the supply circuit of the drive motor of the said first and second conveyor; and a net carrying pipe, placed downstream of the said conveyors, the said net prior sealed at the front extremity in such a way as to constitute a sort of intestine made out of netting, mounted around the external surface of the said net carrying pipe, this having internally a channel through which the containers can pass and along which is able to traverse, guided, alternately in the two directions, a longitudinal element provided with a plurality of equidistant projecting parts, each of which furnished to define a unidirectional locator member in the direction in which each container issues from the pipe, so as to cause each container to move one step at a time from the entry point to the exit point of the pipe and a pair of extension members to support the containers downstream of the exit point of the net pipe;

a station at which each container is enshrouded in a net, placed downstream of the net carrying pipe and completely supported by a carriage that is sustained by the frame in a way whereby it is able to slide, movable alternately in the two directions along the path followed by the containers as they move forward, the said carriage having fixed thereto a net sealing and cutting means and a guillotine device constituted by: a first pair of stationary locator elements of V conformation, placed transversely to the forward movement direction of the containers and spaced with corresponding parallelism in such a way as to accept there between, said sealing and cutting means for sealing and cutting the said front extremity of the net; and a second pair of movable locator elements of upside down V conformation that operate in contrast with the said first elements and are placed there above in planes slightly staggered with respect thereto, the said second elements being able to traverse vertically in the two directions, from a first raised position coinciding with the maximum upstream position of the said carriage towards the net carrying pipe, in which the two pairs of elements form a rhomboid aperture such as to allow the free passage of each net enshrouded container, the front extremity of the said longitudinal element and said pair of extension members destined to support the container prior to its transfer, to way past the guillotine device onto a transiting platform mounted on the carriage, to a second extreme lowered position in which the said carriage is placed sufficiently downstream for the said second movable elements not to come into contact with the said extension members, and in which the vertices of the said V's define a small aperture sufficient to firmly restrain, in the correct position, the front part of the netting immediately upstream of each container already positioned on the transiting platform;

a station for the fitting on of the container reinforcing strips, comprising a reel that is placed upstream of the said guillotine device and supplies a long strip kept at the side of the section of the net issuing from the net carrying pipe and having the extremity thereof initially fastened to the front part of the net, the said strip subsequently being fixed and cut along with the net every time the said sealing and cutting head operates;

a labelling station at which, downstream of a label supply group, a chute is provided fitted to the side of the said first pair of stationary locator elements, for transferring a pair of labels at a time, with one label hanging from one side thereof and with the other label hanging from the other side thereof, in the region of the vertex of the V of the said stationary locator elements, where the said sealing and cutting head operates, the action of this also determining one label being firmly fixed to each container;

and one single main motor, carried by the frame, for providing contemporaneously and on a time relationship basis, the said longitudinal element, the said second movable locator elements and the said carriage, with their motion.

2. Automatic apparatus according to claim 1, wherein the said first conveyor comprises two endless chains, mounted on corresponding pinions and placed one parallel to the other, interconnected through a plurality of idle rollers of a width slightly greater than each of the containers, while the said second conveyor comprises at least one pair of belts whose upper ramification is placed at the same level as the upper surface of the said idle rollers, endlessly mounted around corresponding pulleys and placed one parallel to the other at a distance apart greater than the width of the said longitudinal element that passes there between with the rear extremity thereof in order to withdraw a container, the front pulleys, at least, having a radius greater than the height or the gauge of the longitudinal element.

3. Automatic apparatus according to claim 1, wherein the said main motor provides the said longitudinal element, the said second movable locator elements and the said carriage with their drive through corresponding crank mechanisms each having operatively connected crank, connecting rod and slide, with accuracy in the timing of all the movements being guaranteed by differences in phase between one crank mechanism and the other, all of which rotate at the same angular velocity, while the length of the crank, the connecting rod and the slide of the crank mechanism belonging to the longitudinal element, that of the crank, the connecting rod and the slide, coinciding with the carriage, of the crank mechanism belonging to the second movable locator elements, and that of the crank, the connecting rod and the slide of the crank mechanism belonging to the carriage, is determined by the pre-established positions adopted, in the space, by the longitudinal element, the second movable locator elements and the carriage, respectively.

4. Apparatus according to claim 3, wherein each of the said three cranks is constituted by a disk of a radius equivalent to the length of the corresponding crank.

5. Apparatus according to claim 3, wherein the slide of the crank mechanism belonging to the longitudinal element has at the head thereof a pivot to which is fastened a rod, integral with the longitudinal element, the axis of the said pivot lying in the same horizontal plane as the axis of a further pivot provided on the rear extremity of a frame that supports the net carrying pipe; and a microswitch, fixed to the supporting frame of the apparatus, can be tripped cyclically by a projection with which one of the said disks is provided, each tripping operation giving consent, if the said microswitch is electrically energized, to the halting of the main motor at the very moment when the axes of the said two pivots are coincident, namely the configuration in which the frame that supports the net carrying pipe can be raised and rotated around the said coincident axes in order to permit the said net carrying pipe to be removed or placed in position.

6. Apparatus according to claim 4, wherein the region of the said disk in respect to the movable locator elements, a projection is provided that is destined to hit, cyclically, against a valve that gives consent to a pneumatic device to blow cleansing air into the inside of the sealing and cutting head every time this has operated.

7. Apparatus according to claim 1, wherein in the region of the said guillotine device there is placed a photocell which, when obscured by the passing of a container, trips of micro proximity switch located along the path followed by the carriage, this being destined to set in operation the sealing and cutting head at the time the said carriage is in the said rear position that corresponds to the second extreme lowered position of the said second movable locator elements.

8. Apparatus according to claim 1, wherein the said transiting platform comprises an idler roller surface that is supported by two lateral walls and is movable, in height, from a first extreme raised position, level with the sliding surface of the containers in the net carrying pipe, to a second extreme lowered position for the operation of the said second movable locator elements, in which the longitudinal axis of the container is coincident with the axis of the said small aperture defined by the intersection of the said first stationary locator elements with the said second movable locator elements in the extreme lowered position of these.

9. Automatic apparatus according to claim 8, wherein downstream of the said idler roller surface is pivoted a sloping idler roller surface that is supported by lateral walls and is provided, at the outgoing point, with a pair of sliding rollers movable, in a guided fashion, along a fixed surface that connects the exit of the sliding surface with a station where all the netted containers are collated.

10. Apparatus according to claim 5, wherein the said frame that supports the net carrying pipe is provided with a device for locking itself in the lowered position, since it is constantly subjected to a an upward directed force that is applied downstream of the pivot with which the said frame is provided and is supplied by a gas piston integral with the lower part of the supporting frame of the apparatus, whose purpose is to raise in automatic rotation, the frame that supports the net carrying pipe, once the said locking device has been released.

* * * * *